US011351649B2

(12) United States Patent
Paisley

(10) Patent No.: US 11,351,649 B2
(45) Date of Patent: Jun. 7, 2022

(54) METHOD AND APPARATUS FOR LEVELING AND GRINDING SURFACES

(71) Applicant: Levelgrind, Inc., Washington Court House, OH (US)

(72) Inventor: Christopher M. Paisley, Washington Court House, OH (US)

( * ) Notice: Subject to any disclaimer, the term of this patent is extended or adjusted under 35 U.S.C. 154(b) by 371 days.

(21) Appl. No.: 15/946,559

(22) Filed: Apr. 5, 2018

(65) Prior Publication Data

US 2019/0308291 A1 Oct. 10, 2019

(51) Int. Cl.

| | |
|---|---|
| ***B24B 41/02*** | (2006.01) |
| ***B24B 7/18*** | (2006.01) |
| ***B24B 7/22*** | (2006.01) |
| ***B27B 5/18*** | (2006.01) |
| ***B27B 5/20*** | (2006.01) |
| ***B28D 1/04*** | (2006.01) |
| ***B24B 19/03*** | (2006.01) |
| ***B24B 27/06*** | (2006.01) |
| ***B24B 7/07*** | (2006.01) |
| ***B24B 27/00*** | (2006.01) |

(52) U.S. Cl.

CPC ..... *B24B 7/186* (2013.01); *B24B 7/075* (2013.01); *B24B 7/18* (2013.01); *B24B 7/22* (2013.01); *B24B 7/224* (2013.01); *B24B 19/03* (2013.01); *B24B 27/0038* (2013.01); *B24B 27/06* (2013.01); *B24B 27/0608* (2013.01); *B24B 41/02* (2013.01); *B27B 5/18* (2013.01); *B27B 5/187* (2013.01); *B27B 5/20* (2013.01); *B28D 1/04* (2013.01); *B28D 1/045* (2013.01); *B28D 1/046* (2013.01)

(58) Field of Classification Search

CPC .. B24B 7/18; B24B 7/186; B24B 7/22; B24B 7/224; B24B 7/075; B24B 19/03; B24B 23/02; B24B 27/0015; B24B 27/0038; B24B 27/0608; B24B 41/02; B27B 5/18; B27B 5/187; B27B 5/20; B28D 1/04; B28D 1/045; B28D 1/046

USPC ..... 451/58, 69, 70, 342, 352, 353; 125/13.01, 14

See application file for complete search history.

(56) References Cited

U.S. PATENT DOCUMENTS

| | | | | | |
|---|---|---|---|---|---|
| 800,962 | A | * | 10/1905 | Wattles | B24B 7/188 |
| 2,765,597 | A | | 10/1956 | Ditto | |
| 2,854,767 | A | * | 10/1958 | Smith | E02F 3/7659 37/384 |
| 3,275,048 | A | | 9/1966 | Statler et al. | |
| 3,360,298 | A | * | 12/1967 | Markovich | B28D 1/045 299/41.1 |
| 3,464,737 | A | * | 9/1969 | Harclerode | B28D 1/045 299/39.4 |
| 4,456,303 | A | * | 6/1984 | Due | B28D 1/045 125/14 |
| 4,557,245 | A | | 12/1985 | Bieri | |
| 4,614,063 | A | | 9/1986 | Crivaro | |
| 4,762,371 | A | | 8/1988 | Lupton | |
| 4,998,775 | A | | 3/1991 | Hollifield | |
| 5,582,899 | A | * | 12/1996 | Chiuminatta | B24B 19/02 264/154 |

(Continued)

*Primary Examiner* — Eileen P Morgan
(74) *Attorney, Agent, or Firm* — Bryce D. Miracle, Esq.

(57) ABSTRACT

A floor leveling apparatus and method for cutting parallel grooves in a hardened body which is configured to assist in utilizing a grinder to finish surfaces in a planar manner.

3 Claims, 3 Drawing Sheets

(56) References Cited

U.S. PATENT DOCUMENTS

| | | | | |
|---|---|---|---|---|
| 6,131,557 | A * | 10/2000 | Watson | B23D 59/001 125/13.01 |
| 6,371,566 | B1 | 4/2002 | Haehn | |
| 6,990,972 | B2 * | 1/2006 | Markley | B23D 47/02 125/13.01 |
| 7,918,512 | B2 * | 4/2011 | Mannebach | E01C 23/065 299/39.4 |
| 8,220,806 | B2 | 7/2012 | Neudeck | |
| 8,425,279 | B2 * | 4/2013 | Gurley | B28D 5/024 451/69 |
| 9,010,310 | B2 * | 4/2015 | Bockes | E01C 23/0933 125/12 |
| 2004/0173198 | A1 * | 9/2004 | Glenn | B28D 1/045 125/13.01 |
| 2008/0248725 | A1 | 10/2008 | Craycraft | |
| 2009/0221219 | A1 | 9/2009 | Fudala | |
| 2009/0272068 | A1 | 11/2009 | Shaw | |
| 2011/0155114 | A1 * | 6/2011 | Bockes | B28D 1/045 125/12 |
| 2018/0147745 | A1 * | 5/2018 | Moller | B28D 1/041 |

* cited by examiner

METHOD AND APPARATUS FOR LEVELING AND GRINDING SURFACES

FIELD OF THE INVENTION

The present invention relates to the field of finishing surfaces, and more specifically, to a method and apparatus for the leveling of concrete and other masonry surfaces, thereby producing a top planar surface.

BACKGROUND

For many years professionals who deal with finishing surfaces including flooring have had great difficulties accurately and efficiently removing high and low spots commonly found on concrete floors and other masonry surfaces. Existing floor or concrete grinders are often used; however, grinders are notable in that they do not produce a planar surface, leaving behind high and low spots providing an uneven, irregular surface—commonly found on concrete floors. Put simply, while floor grinders have been beneficial at reducing the time necessary to prepare a floor, by quickly removing adhesives and excess cement, they still have not been able to produce a consistently flat and planar top surface.

In more detail, conventional floor grinders have rotating discs that make the floor flat within an area limited to the surface area of the discs but not relative to the rest of the area of the floor. Furthermore, these grinders are moved around the floor by way of wheels which simply roll over the high and low spots and, therefore, do not compensate for the varying elevations of the floor. The operator of the grinder, while working on area of the floor, has no idea how it correlates to the other areas of the floor. In order to see these high and low spots one must put a straight edged tool on the floor in both an 'x' and 'y' direction. Therefore, use of such conventional grinders relies greatly on skill and the time spent devoted to leveling the floor.

For the foregoing reasons, there is a need for an improved method an apparatus which produces a consistent planar top surface.

SUMMARY

In accordance with the invention, a floor leveling apparatus and method for cutting parallel grooves in a hardened body is provided which is configured to assist in utilizing a grinder to finish surfaces in a planar manner.

In a version of the application, a floor leveling apparatus for cutting at least one groove in a hardened body, the bottom surface of the groove defining a benchmark line. The apparatus comprising: a support beam having a first end and a second end; a plurality of support stands operably configured for mounting the support beam above the hardened body at each end, the support stands having an adjustable length for adjusting the height position of the support beam at each end defining a plane above the floor; and a masonry saw assembly having a masonry disc blade operably configured for mounting to the support beam and for being movable along a length of the support beam.

In certain versions, the apparatus may further comprise a blade position adjustment mechanism for adjusting the respective distance between the beam and the masonry disc blade.

In other certain versions, each support stand is positioned at each end of the support beam, each support stand comprising: a base structure for stabilizing the support stand to an adjacent surface; and an adjustment mechanism for adjusting the height of the respective end of the support beam. In a detailed version, the adjustment mechanism is configured to selectively adjust the height of the respective end. The adjustment mechanism for adjusting the height comprises: a threaded shaft and a reciprocally threaded rod configured to longitudinally move through the shaft when rotated. Thereby, when the rod is rotated, the end of the beam is caused to move up or down, therefore, adjusting the exact height of the respective end of the support beam.

In other certain versions, the apparatus may further comprise a carriage having a housing configured for selectively mounting the masonry saw to the support beam.

In yet another version of the application, a floor leveling apparatus is provided for cutting a plurality of grooves in a hardened body formed by concrete or other hardened body, the bottom surface of the grooves collectively defining a benchmark plane. The apparatus generally comprises: a first and second rails configured for being mounted spaced apart from and parallel to the other; a support beam for supporting the masonry saw above the hardened body having a first end and a second end, the support beam configured for mounting between the rails and for being movable along a length the rails; a plurality of support stands operably configured for mounting the first and second rails above the floor, the support stands having an adjustable length for adjusting the height position of the first and second rails such that the rails define a simulated plane above the hardened body; and a masonry saw assembly having a masonry disc blade operably configured for mounting to the support beam and for being movable along a length of the support beam.

The application also provides a unique method for producing a planar finished floor surface by cutting a plurality of grooves in a hardened body formed by concrete or other material, the bottom surface of the grooves forming a level finished benchmark plane. In a version of the method, the method comprises the steps of: a) providing an apparatus comprising: a first and second rails configured for being mounted spaced apart from and parallel to the other; a support beam for supporting the masonry saw above the hardened body having a first end and a second end, the support beam configured for mounting between the rails and for being movable along a length the rails; a plurality of support stands operably configured for mounting the first and second rails above the floor, the support stands having an adjustable length for adjusting the height position of the first and second rails such that the rails define a simulated plane above the floor; and a masonry saw assembly comprising: a masonry disc blade operably configured for mounting to the support beam and for being movable along a length of the support beam; and a blade position adjustment mechanism for adjusting the respective distance between the simulated plane and the benchmark finished plane formed by the plurality of groove bottom surfaces; b) positioning the apparatus over the location of the desired portion of the floor to be finished; c) adjusting lengths of the one or more of the plurality of support stands defining the simulated plane above of the floor echoing the desired analogous finished benchmark plane; d) positioning the beam at a first position along the length of the rails; e) defining the depth of the bottom surface of the grooves forming the benchmark plane by adjusting the blade position adjustment mechanism; f) defining a first groove by operating the masonry saw along the beam at the first position; g) positioning the beam at a second position along the length of the rails; h) defining at least a second groove by operating the masonry saw along the length of the beam at the second position; and i) wherein the bottom surface of each of the plurality of grooves collectively form the benchmark plane of the finished surface.

In a certain version of the method, the method further comprises the steps of: j) providing a grinding machine for finishing a floor surface; and k) grinding the hardened body down to the benchmark plane formed by the bottom surface of each of the plurality of grooves, thereby forming a level, planar finished surface.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other versions that depart from these specific details. In other instances, detailed descriptions of well-known devices, circuits, and methods are omitted so as not to obscure the description of the present invention with unnecessary detail.

Moreover, the description is not to be taken in the limiting sense, but is made merely for the purpose illustrating the general principles of the invention, since the scope of the invention is best defined by the appended claims. Various inventive features are described below that can each be used independently of one another or in combination with other features.

Unless otherwise defined, all technical terms used herein have the same meaning as commonly understood by one of ordinary skill in the art to which the invention belongs. As used in the specification and the appended claims, the singular forms "a," "an," and "the" include plural references unless the context clearly dictates otherwise. Any reference to "or" herein is intended to encompass "and/or" unless otherwise stated.

Figure 1:
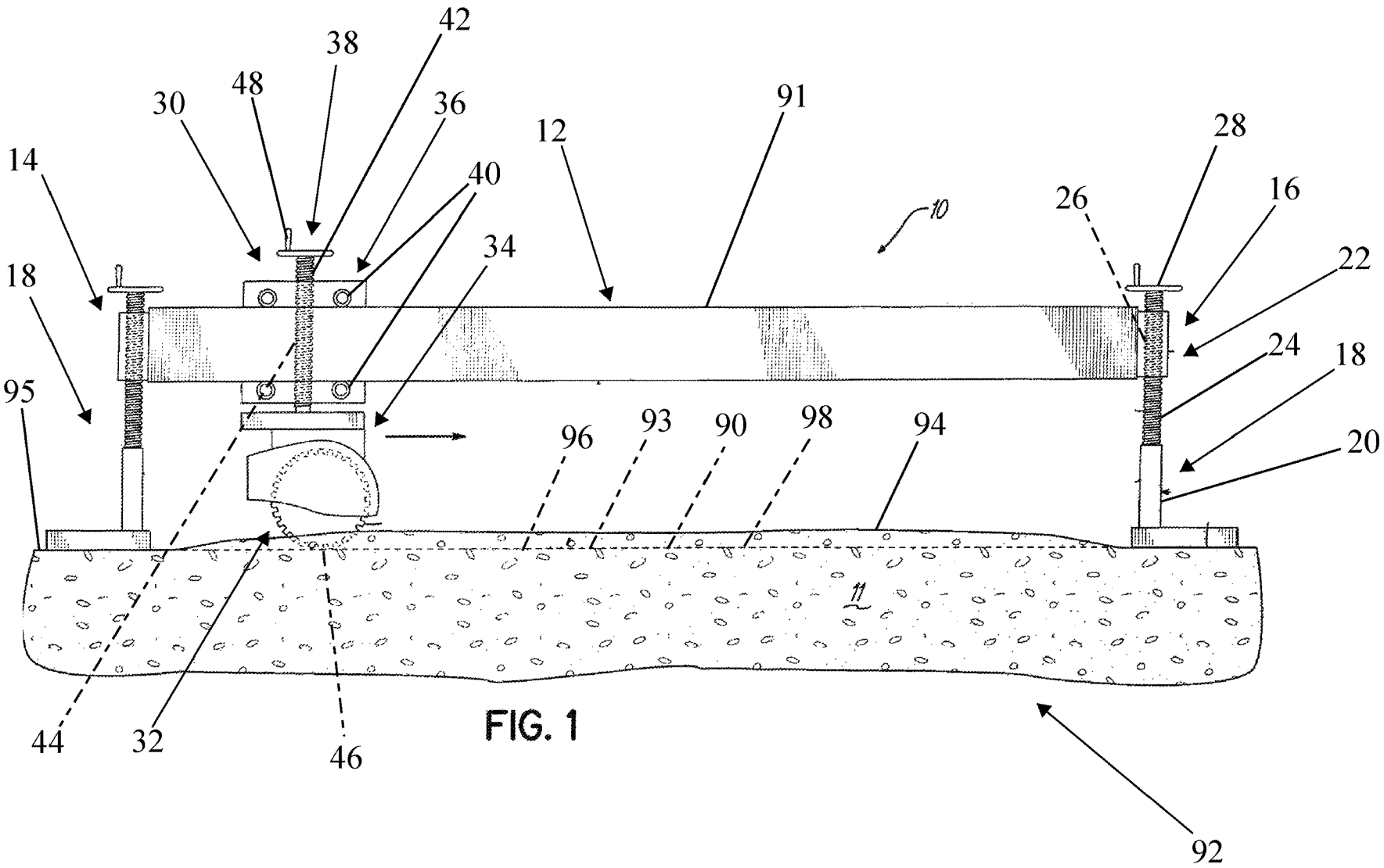
FIG. 1 is front elevation view illustrating a first version of the application.
Figure 2:
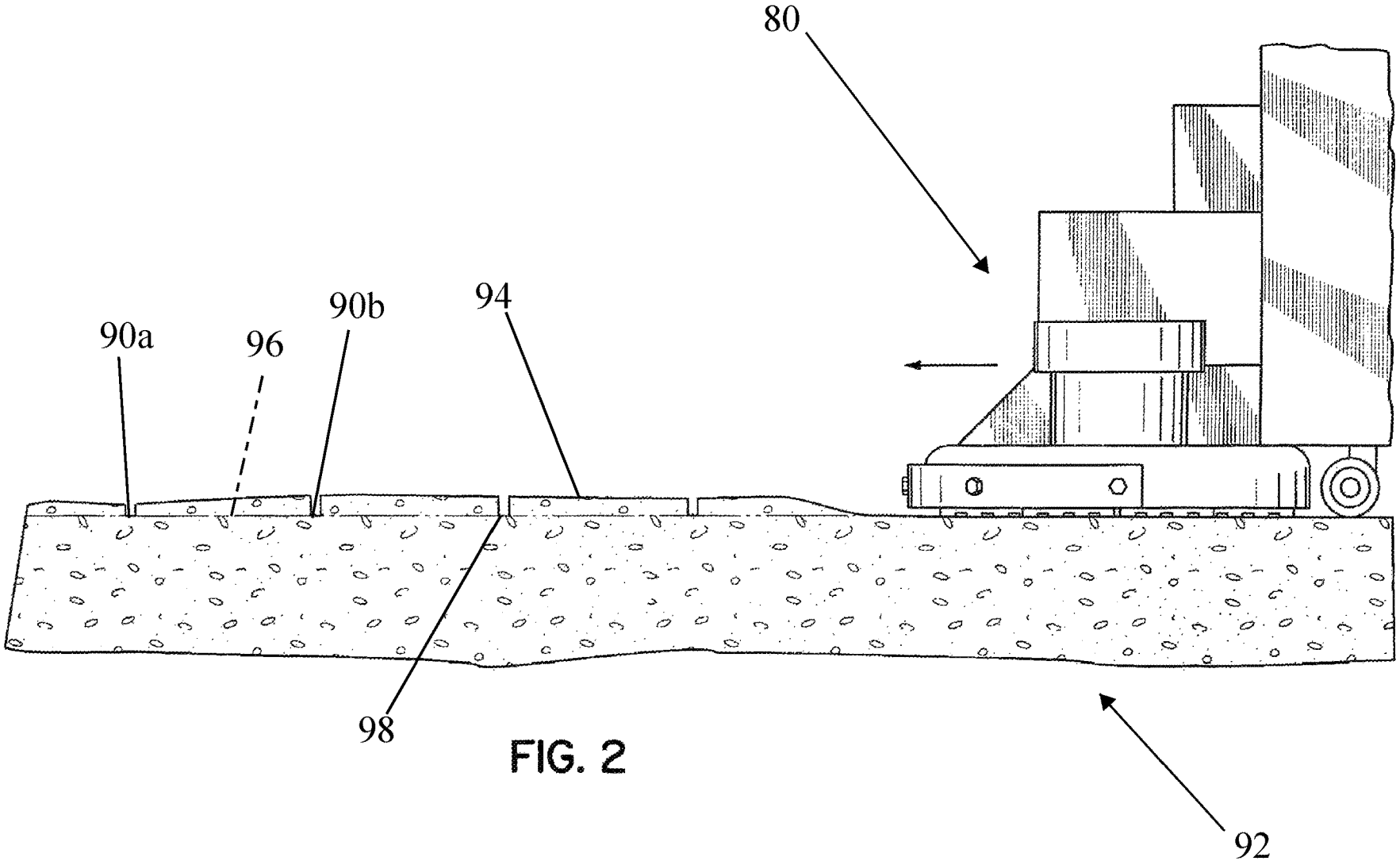
FIG. 2 is a front elevation view illustrating a version of the application.
Figure 3:
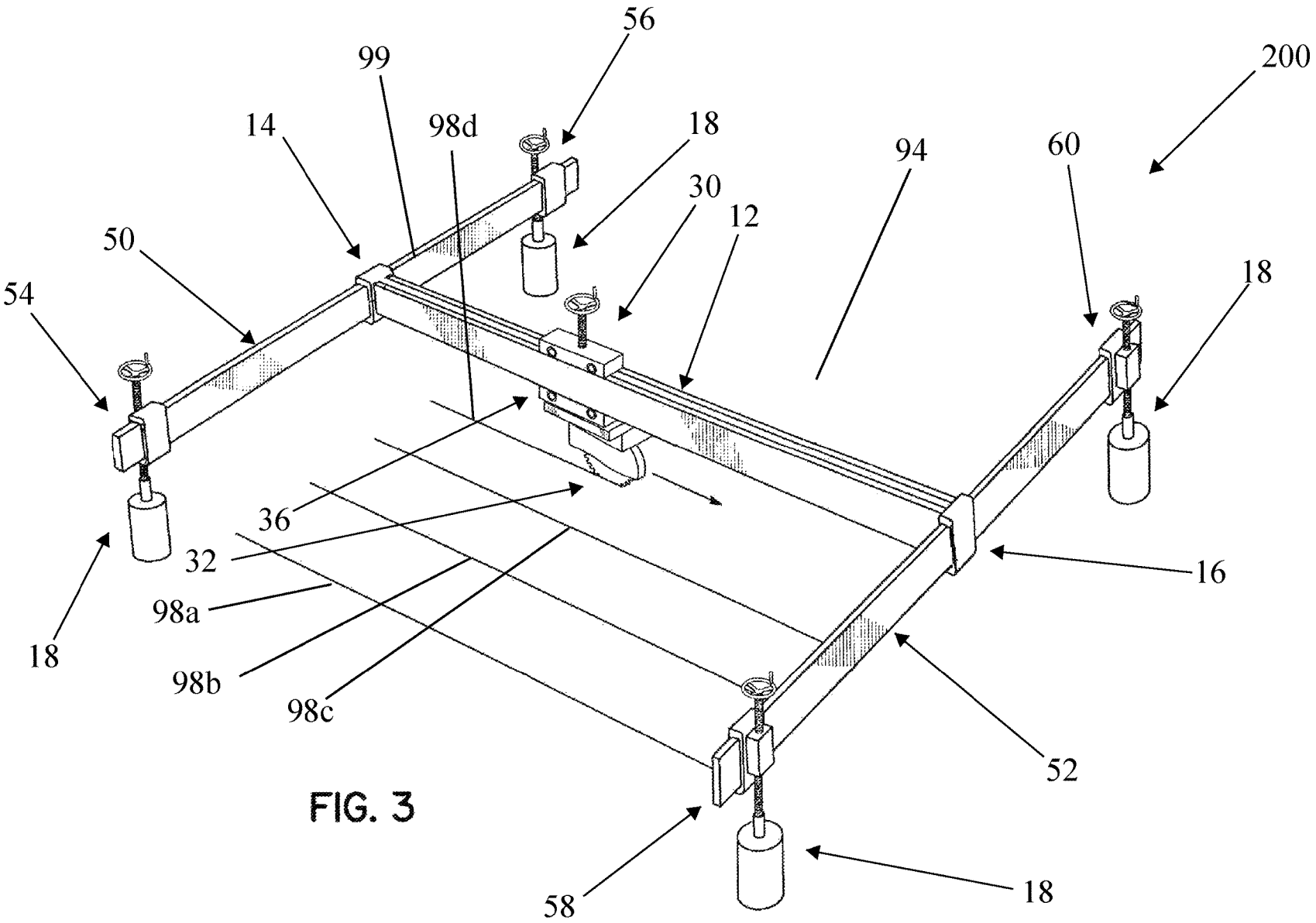
FIG. 3 is a side perspective view illustrating a second version of the application.

With reference to the figures FIG. 1-FIG. 3, a description of a version of the invention will be provided and a first version is generally designated as numeral 10. Generally speaking, the application is directed towards a method and apparatus for leveling and grinding surfaces, particularly hardened concrete or other masonry type surfaces. In particular, a unique method and apparatus in provided which produces a plurality of aligned grooves having bottom surfaces which collectively define a benchmark plane of reference. Thereafter, a surface or floor grinder is utilized to progressively grind the top surface of the floor even with the benchmark plane defined by the plurality of grooves which will be described in detail below.

In a first version of the application and as best illustrated by FIG. 1, an apparatus 10 is provided which is configured to cut at least one linear groove 90 into a hardened body 92 having a top surface 94. The groove 90 is configured to define a depth corresponding to a desired benchmark plane 96 which passes through and is even with the bottom surface 98 of the groove 90. The version of the apparatus 10 generally comprises a support truss or beam 12 having a longitudinal length extending between a first and second ends 14, 16; a plurality of support stands operably configured for mounting the support beam 12 above the hardened body 92; and a masonry saw assembly 30 having a masonry disc blade 32.

The beam 12 is supported in a horizontal manner by the plurality of support stands 18 which are operably configured for mounting the support beam 12 above the hardened body 92 top surface 94, ideally at each end 14, 16. Each of the support stands is generally configured to have a selectively adjustable height for adjusting the height position of each end 14, 16 of the beam 12 defining a simulated groove line 91 and slope above the hardened body 92 top surface 94. The simulated groove line 91 simulates the slope of the benchmark line 93 formed by the bottom surface 98 of the respective groove 90. This allows the user to make final adjustments and tweaks before a cut is made into the hardened surface forming the more permanent benchmark line 93.

In the illustrated version, each of the support stands 18 generally comprises a base structure 20 and an adjustment mechanism assembly 22. In the version, the base structure 20 is configured to provide an enlarged footprint for stabilizing the support stand 18 to the adjacent surface 95 of the top surface 94. The adjustment mechanism assembly 22 is configured to selectively adjust the height of the respective end 14, 16 of the support beam 12. In the version, the adjustment assembly 22 comprises an externally threaded rod 24 corresponding to a reciprocally threaded shaft 26. Thus, when the rod 24 is rotated by way of the handle 28, the end 14 of the beam 12 is caused to move up or down, thereby adjusting the exact height of the respective end of the support beam 12.

Further as illustrated, the masonry saw assembly 30 is operably configured for mounting to the support beam 12 and for being movable along a length of the support beam 12. In the version, the masonry saw assembly 30 comprises a masonry disc blade 32, a motor 34 to operate the blade 32, a carriage assembly 36 for moving the saw masonry assembly 30 along the length of the beam 12, and a blade position adjustment mechanism 38.

In the version, the carriage assembly 36 provides a structure having a plurality of rollers 40 which are operably configured and positioned to allow the masonry saw assembly 12 to smoothly glide in a linear manner along the operable length of the beam 12. The masonry disc blade 32 and motor 34 are operably suspended below the carriage assembly 36. Moreover, the disc blade 32 is operably aligned in the direction of travel along the beam 12 in order to cut along the intended benchmark line 93. The disc blade 32 can be of any type of blade known in the industry to cut concrete or other hardened masonry material.

The blade adjustment mechanism 38 is configured to provide a mechanism for adjusting the respective distance between the beam 12 and the lowest contact point 46 of the masonry disc blade 32. In the version, the blade position adjustment mechanism 38 generally comprises an externally threaded rod 42 and a correspondingly reciprocally threaded shaft 44. The shaft 44 is operably integral with the carriage assembly 36 and the rod 42 is operably attached to the blade 32. Thus, when the rod 42 is rotated by way of the handle 48, the masonry disc blade 32 is caused to move up or down, thereby adjusting the exact depth and path of the disc blade 32 throughout the operation path along the beam 12—defining the benchmark line 93.

Now referring to FIG. 3, a second version of the application is shown. The version 200 is configured to cut a plurality of linear grooves 90*a-d* into a hardened body 92 formed by concrete or other masonry surface having a top surface 94. Collectively, the bottom surfaces 98*a-d* of the grooves 90*a-d* collectively define a benchmark plane 96 which will form the basis for the finished plane surface after grinding of the hardened body 92 top surface 94. Specifically, the benchmark plane 96 passes through and is flush with the bottom surfaces 98 of the grooves 90.

In the version, the apparatus 200 generally comprises the previously described parts; however, further comprises a first and second rails 50, 52 which are configured for being mounted spaced apart from and parallel to the other. The support beam 12 for supporting the masonry saw assembly 30 above the hardened body 92 is operably mounted between the rails 50, 52 and is movable along a length of the rails 50, 52.

Similar to the first version 10 of the application, a plurality of support stands 18 are provided which are configured for mounting the first and second rails 50, 52 above the top surface 94 of the hardened body 92. Generally, each of the support stands 18 is configured to have an adjustable length for adjusting the height position of the first and second rails 50, 52 such that the rails 50, 52 define a simulated plane above the hardened body 92.

In a detailed version as illustrated in FIG. 3, each of the support stands 18 is generally configured to have a selectively adjustable height for adjusting the height position of each end of each rail 54, 56, 58, 60 defining a simulated plane and slope above the hardened body 92 top surface 94. The simulated plane mimics the plane and slope of the benchmark plane 96 collectively formed by the bottom surface 98*a-d* of the respective grooves 90*a-d*. This allows the user to make final adjustments and tweaks to the desired outcome of the floor before the plurality of grooves 90*a-d* are cut into the hardened body 92, top surface 94 forming the more permanent benchmark plane 96 beneath the surface of the hardened body 92.

In the illustrated version, each of the support stands 18 generally comprises a base structure 20 and an adjustment mechanism assembly 22. In the version, the base structure 20 is configured to provide an enlarged, preferably weighted footprint for stabilizing the support stand 18 and respective rail portion to the adjacent surface 95 of the top surface 94. The adjustment mechanism assembly 22 is configured to selectively adjust the height of the respective rail end 54, 56, 58, 60 which collectively form the simulated plane 99 above the hardened body 92.

In the version, the adjustment assembly 22 comprises an externally threaded rod 24 corresponding to a reciprocally threaded shaft 26. Thus, when the rod 24 is rotated by way of the handle 28, the respective end of the respective rail 50, 52 is caused to move up or down, thereby adjusting the simulated slope and plane of the simulated plane 99. Overall, once the apparatus 200 is positioned adjacent to the hardened body top surface, each of the stands are individually or simultaneously adjusted in height in order to define the simulated plane 99 before the plurality of grooves are cut.

A version of the method of operation of the apparatus 200 will now be described in detail. Generally speaking, the method produces a planar finished floor surface by cutting a plurality of grooves 90*a-d* in a hardened body 92 formed by concrete or other material, the bottom surface 98*a-d* of the grooves 90*a-d* form a level finished benchmark plane 96, the method comprising the steps of: i) providing a version of the apparatus described above; ii) positioning the apparatus over the location of the desired portion of the hardened body 92 or floor to be finished; iii) adjusting lengths of the one or more of the plurality of support stands 18 defining the simulated plane 99 above of the floor 92 echoing the desired analogous finished benchmark plane 96; iv) positioning the beam 12 at a first position along the length of the rails 50, 52; v) defining the depth of the bottom surface 98 of the grooves 90 forming the benchmark plane 96 by adjusting the blade position adjustment mechanism 38; vi) defining a first groove 90*a* by operating the masonry saw assembly 30 along the beam 12 at the first position; vii) positioning the beam 12 at a second position along the length of the rails 50, 52; viii) defining at least a second groove 90*b* by operating the masonry saw 30 along the length of the beam 12 at the second position; wherein the bottom surface 98 of each of the plurality of grooves 90 collectively form the benchmark plane 93 of the finished surface. Thereafter, the floor is ready to be finished by grinding the excess material down to the benchmark plane 93, thereby providing a planar, finished surface.

In certain versions of the invention, a grinding machine 80 is provided (FIG. 2). The grinding machine 80 is utilized to grind the hardened body 92 down to the benchmark plane 96 formed by the bottom surface 98 of each of the plurality of grooves 90, thereby forming a level, planar finished surface.

A concrete grinder 80 can come in many configurations, the most common being a hand-held angle grinder or purpose-built floor grinders that are used for grinding and polishing marble, granite and concrete (FIG. 2).

Concrete grinders 80 use some sort of abrasive to grind or polish such as diamond tools or silicon carbide. The diamond tools used for grinding most commonly are diamond grinding cup wheels, and for polishing are usually diamond polishing pads. The use of diamond tooling is the most common type of abrasive used under concrete grinders and come in many grits.

The invention does not require that all the advantageous features and all the advantages need to be incorporated into every version of the invention.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A method for producing a planar finished floor surface by cutting a plurality of grooves, each having a bottom surface, into a hardened body formed by concrete or other material, the bottom surface of the grooves collectively forming a level finished benchmark plane, the method comprising the steps of:

providing an apparatus comprising:

a first and second rails configured for being mounted spaced apart from and parallel to the other;

a support beam having a first end and a second end, the support beam configured for mounting between the rails and for being movable along a length the rails;

a plurality of support stands operably configured for mounting the first and second rails above the hardened body, the support stands having an adjustable length for adjusting a height position of the first and second rails such that the rails define a simulated plane above the hardened body; and a masonry saw assembly comprising: a masonry disc blade operably configured for mounting to the support beam and for being movable along a length of the support beam; and a blade position adjustment mechanism for adjusting the respective distance between the simulated plane and the finished benchmark plane formed by the collective bottom surfaces of the plurality of grooves;

positioning the apparatus over a location of a desired portion of the hardened body to be finished;

adjusting lengths of the one or more of the plurality of support stands defining the simulated plane above of the hardened body;

positioning the support beam at a first position along the length of the rails;

defining a depth of the bottom surface of the grooves forming the benchmark plane by adjusting the blade position adjustment mechanism;

defining a first groove by operating the masonry saw along the beam at the first position;

positioning the beam at a second position along a length of the rails;

defining at least a second groove by operating the masonry saw along the length of the beam at the second position;

positioning the beam at a third position along a length of the rails;

defining at least a third groove by operating the masonry saw along the length of the beam at the third position; and wherein the bottom surface of each of the plurality of grooves collectively form the benchmark plane of a finished surface.

2. The method for producing a planar finished floor surface by cutting a plurality of grooves, each having a bottom surface, into a hardened body formed by concrete or other material of claim 1, further comprising the steps of:

a) providing a grinding machine; and b) grinding the hardened body down to the benchmark plane formed by the bottom surface of the plurality of grooves, thereby forming the level, planar finished surface.

3. A method for producing a planar finished floor surface by cutting a plurality of grooves, each having a bottom surface, into a hardened body formed by concrete or other material, the bottom surface of the grooves collectively forming a level finished benchmark plane, the method comprising the steps of:

providing an apparatus comprising:

a first and second rails configured for being mounted spaced apart from and parallel to the other;

a support beam having a first end and a second end, the support beam configured for mounting between the rails and for being movable along a length the rails;

a plurality of support stands operably configured for mounting the first and second rails above the hardened body, the support stands having an adjustable length for adjusting a height position of the first and second rails such that the rails define a simulated plane above the hardened body; and a masonry saw assembly comprising: a masonry disc blade operably configured for mounting to the support beam and for being movable along a length of the support beam; and a blade position adjustment mechanism for adjusting the respective distance between the simulated plane and the finished benchmark plane formed by the collective bottom surfaces of the plurality of grooves;

positioning the apparatus over a location of a desired portion of the hardened body to be finished;

adjusting lengths of the one or more of the plurality of support stands defining the simulated plane above of the hardened body;

positioning the support beam at a first position along the length of the rails;

defining a depth of the bottom surface of the grooves forming the benchmark plane by adjusting the blade position adjustment mechanism;

defining a first groove by operating the masonry saw along the beam at the first position;

positioning the beam at a second position along a length of the rails;

defining at least a second groove by operating the masonry saw along the length of the beam at the second position;

positioning the beam at a third position along a length of the rails;

defining at least a third groove by operating the masonry saw along the length of the beam at the third position; and wherein the bottom surface of each of the plurality of grooves collectively form the benchmark plane of a finished surface;

after the benchmark plane is formed, providing a grinding machine; and grinding the hardened body down to the benchmark plane formed by the bottom surface of the plurality of grooves, thereby forming the level, planar finished surface.

* * * * *